US009272522B1

(12) United States Patent
Kosaka et al.

(10) Patent No.: US 9,272,522 B1
(45) Date of Patent: Mar. 1, 2016

(54) PRINTING APPARATUS AND INK AMOUNT DETECTION METHOD

(71) Applicant: CANON KABUSHIKI KAISHA, Tokyo (JP)

(72) Inventors: Kei Kosaka, Tokyo (JP); Atsushi Takahashi, Tama (JP); Tomoyuki Tenkawa, Yokohama (JP); Akiyoshi Sahara, Funabashi (JP); Toshiyuki Kuroda, Yokohama (JP); Kei Takarabe, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/829,333

(22) Filed: Aug. 18, 2015

(30) Foreign Application Priority Data

Aug. 25, 2014 (JP) ..... 2014-170340

(51) Int. Cl.
*B41J 29/38* (2006.01)
*B41J 2/175* (2006.01)

(52) U.S. Cl.
CPC ..... *B41J 2/17566* (2013.01); *B41J 2/175* (2013.01); *B41J 2/17506* (2013.01); *B41J 2/17509* (2013.01); *B41J 2/17596* (2013.01)

(58) Field of Classification Search
CPC .... B41J 2/175; B41J 2/17506; B41J 2/17596; B41J 2/17509; B41J 2/17566
See application file for complete search history.

(56) References Cited

U.S. PATENT DOCUMENTS

2010/0066773 A1* 3/2010 Taga ..... B41J 2/175 347/6
2012/0286065 A1* 11/2012 Lin ..... B05B 3/0409 239/225.1

FOREIGN PATENT DOCUMENTS

JP 2010-069845 4/2010
JP 2012-096363 5/2012

OTHER PUBLICATIONS

U.S. Appl. No. 14/829,336, filed Aug. 18, 2015; Inventors: Atsushi Takahashi, Kei Kosaka, Tomoyuki Tenkawa, Naozumi Nabeshima.

* cited by examiner

*Primary Examiner* — Lisa M Solomon
(74) *Attorney, Agent, or Firm* — Fitzpatrick, Cella, Harper & Scinto

(57) ABSTRACT

A printing apparatus includes a main tank for containing ink; a sub tank for containing ink supplied from the main tank and containing ink to be supplied to a print head; a detection unit configured to detect an ink amount in the sub tank; and a filling unit configured to perform ink filling operation that fills the sub tank with ink from the main tank by driving a driving unit, in a case where the detection unit detects the ink amount in the sub tank that is less than a first predetermined amount, wherein in a case where the ink amount in the main tank is less than a second predetermined amount, the filling unit drives the driving unit at smaller drive amount than that in a case where the ink amount in the main tank is greater than the second predetermined amount.

10 Claims, 23 Drawing Sheets

PRINTING APPARATUS AND INK AMOUNT DETECTION METHOD

BACKGROUND OF THE INVENTION

1. Field of the Invention

The present invention relates to a printing apparatus and an ink amount detection method. In particular, the invention relates to the ink amount detection for a main tank in an ink supply system including a sub tank for directly supplying ink to a print head and the main tank for containing ink to be supplied to the sub tank.

2. Description of the Related Art

An ink supply system of an inkjet printing apparatus which includes a main tank and a sub tank allows the printing apparatus to continue a printing operation using ink in the sub tank even when there is no more ink in the main tank for example. One configuration to fill the sub tank with ink from the main tank in the ink supply system as described above is disclosed in Japanese Patent Laid-Open No. 2012-096363. According to Japanese Patent Laid-Open No. 2012-096363, when a liquid level detection unit in the sub tank detects that the amount of ink in the sub tank is reduced to a level lower than a predetermined liquid level, then an ink filling mechanism fills the sub tank with a predetermined amount of ink from the main tank. Then, when the ink filling operation is completed and when the liquid level detection unit detects that the ink liquid level in the sub tank is again equal to or higher than the predetermined liquid level, it is determined that the sub tank is filled with ink and a subsequent printing operation for example is performed.

In the ink supply system in such a configuration, even when an operation to fill a predetermined amount of ink is repeated a predetermined times while the liquid level detection unit in the sub tank detects the liquid level is lower than the predetermined liquid level, a case may be caused in which it may be determined that there is ink shortage in the main tank if the liquid level in the sub tank is lower than the predetermined liquid level.

However, in such a configuration, regardless of the amount of ink remaining in the main tank, the predetermined number of ink filling operations may be repeated and ink shortage in the main tank may be determined if the liquid level in the sub tank does not reach a predetermined liquid level or more. Thus, if the amount of ink in the main tank is small for example, the amount of ink that can be filled by a single filling operation may be lower than the above described predetermined amount. In this case, even when the predetermined number of the filling operations as a reference is repeated, the predetermined liquid level is not reached, thus consequently causing the predetermined number of the filling operations to be unnecessary. This means that unnecessary ink filling operations are performed to cause a proportional increase of time required to determine there is ink shortage in the main tank.

SUMMARY OF THE INVENTION

An object of the present invention is to provide an printing apparatus and an ink amount detection method according to which, depending on the amount of ink remaining in the main tank, a condition is determined as a reference for determining whether ink remains in the main tank or not to thereby prevent an unnecessary increase of the time required to determine whether ink remains in the main tank.

In a first aspect of the present invention, there is provided a printing apparatus comprising: a main tank for containing ink; a sub tank for containing ink supplied from the main tank and containing ink to be supplied to a print head; a detection unit configured to detect an ink amount in the sub tank; and a filling unit configured to perform ink filling operation that fills the sub tank with ink from the main tank by driving a driving unit, in a case where the detection unit detects the ink amount in the sub tank that is less than a first predetermined amount, wherein in a case where the ink amount in the main tank is less than a second predetermined amount, the filling unit drives the driving unit at smaller drive amount than that in a case where the ink amount in the main tank is greater than the second predetermined amount.

In a second aspect of the present invention, there is provided an ink filling method for filling a sub tank with ink in a printing apparatus including a main tank for containing ink, the sub tank for containing ink supplied from the main tank and containing ink to be supplied to a print head, and a detection unit configured to detect an ink amount in the sub tank, the method comprising: a step of filling the sub tank with ink from the main tank by driving a driving unit, in a case where the detection unit detects the ink amount in the sub tank that is less than a first predetermined amount, wherein in the step, in a case where the ink amount in the main tank is equal to or less than a second predetermined amount, the driving unit is driven at smaller drive amount than that in a case where the ink amount in the main tank is greater than the second predetermined amount.

According to the above configuration, depending on the amount of ink remaining in the main tank, a condition is determined as a reference for determining whether ink remains in the main tank or not to thereby prevent an unnecessary increase of the time required to determine whether ink remains in the main tank.

Further features of the present invention will become apparent from the following description of exemplary embodiments (with reference to the attached drawings).

DESCRIPTION OF THE EMBODIMENTS

Embodiments of the present invention will be described in detail with reference to drawings.

First Embodiment

Figure 1:
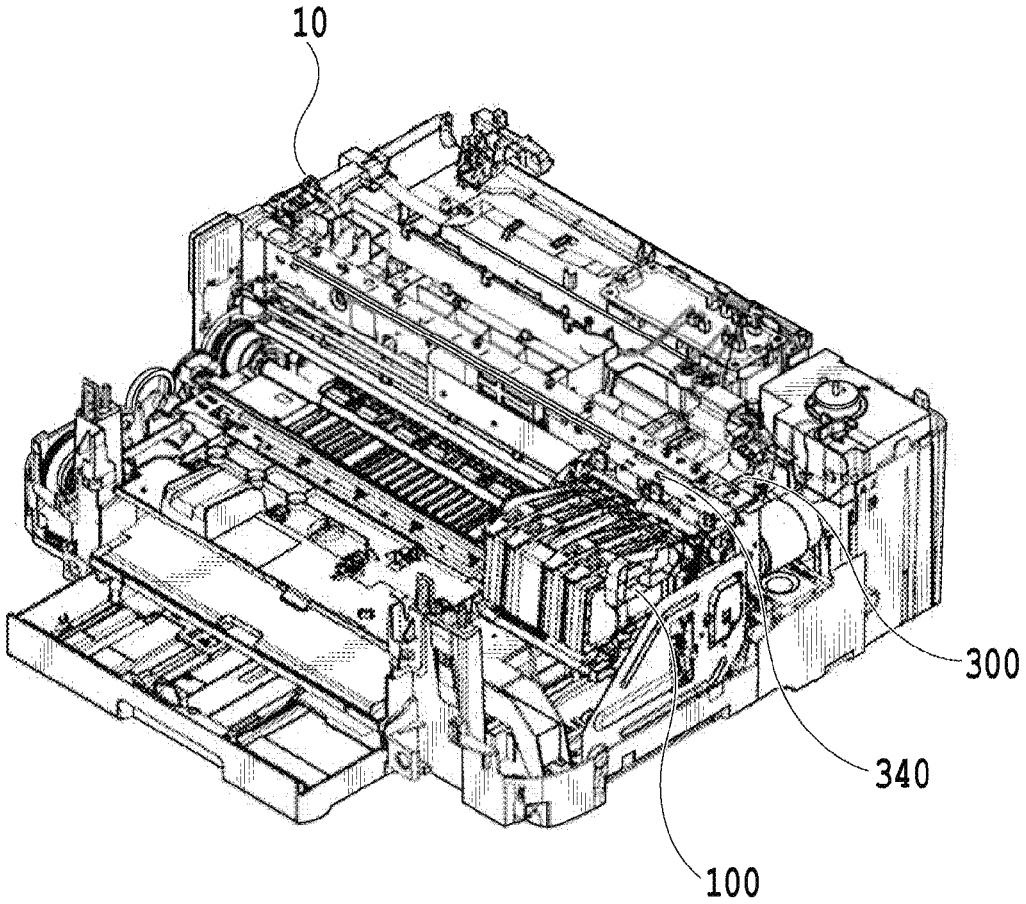
FIG. 1 is a perspective view illustrating an inkjet printing apparatus according to one embodiment of the present invention except for a cover.
Figure 2:
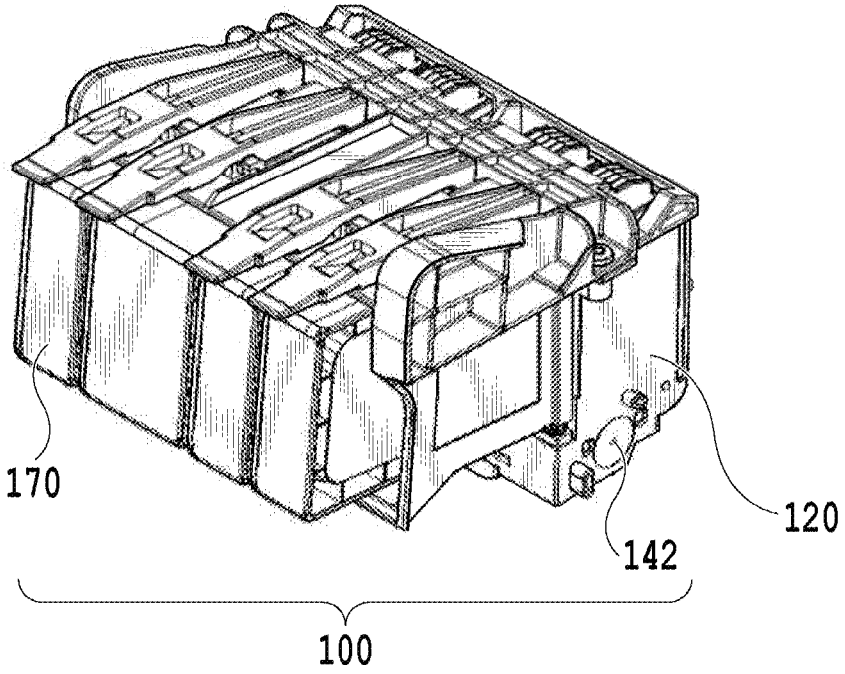
FIG. 2 is a perspective view illustrating the details of the print head unit 100 shown in FIG. 1.
Figure 3:
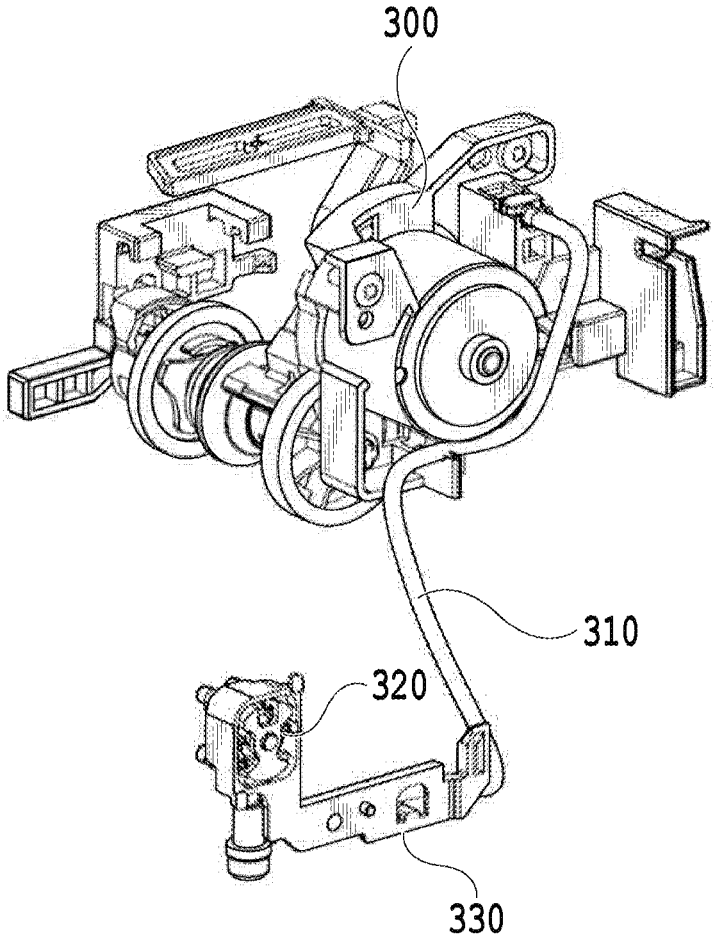
FIG. 3 illustrates the details of a pump unit 300 shown in FIG. 1.

FIGS. 1 to 3 illustrate the configuration of an inkjet printing apparatus according to one embodiment of the present invention. Specifically, FIG. 1 is a perspective view illustrating the inkjet printing apparatus with a cover being removed. FIG. 2 is a perspective view illustrating the details of the print head unit 100 shown in FIG. 1. FIG. 3 is a view illustrating the details of the pump unit 300 shown in FIG. 1.

In these drawings, an inkjet printing apparatus 10 includes the print head unit 100, a carriage unit 340 that is movable with mounting the print head unit 100, a feeding mechanism for feeding a print medium such as a print paper, and a conveying mechanism for conveying the print medium fed through the feeding mechanism to the printing portion by the printing unit. A pump unit 300 is provided at one end of the movement range of the carriage unit 340. At the bottom face side of the inkjet printing apparatus 10, a paper feed tray is provided. A print medium placed in the paper feed tray is fed through the feeding mechanism.

The print head unit 100 is configured to include a print head (not shown), a sub tank (not shown) for which the details will be described later, and a main tank 170. Depending on the ink ejection operation of the print head, ink is supplied from the sub tank to the print head. When the ink amount in the sub tank is lower than a predetermined amount, ink is supplied from the main tank 170 to the sub tank. The print heads, the sub tanks, and the main tanks are prepared for each of the types of inks. In this embodiment, the print heads, the sub tanks, and the main tanks are prepared for each of four colors of inks (i.e., inks of yellow (Y), black (Bk), cyan (C), and magenta (M)). The pump unit 300 is configured to include a tube pump and a motor for driving the rotation of a tube pressing roller for squeezing the tube of the tube pump. The pump unit 300 further includes a guide unit 330 and includes a suction pad 320 for contacted to the decompression opening of the sub tank, and a tube 310 for the communication between the suction pad and the tube pump. This allows the pump unit 300 to perform, when the sub tank is filled with ink from the main tank 170, the suction to decompress the decompression chamber of the sub tank as described later.

Figure 4:
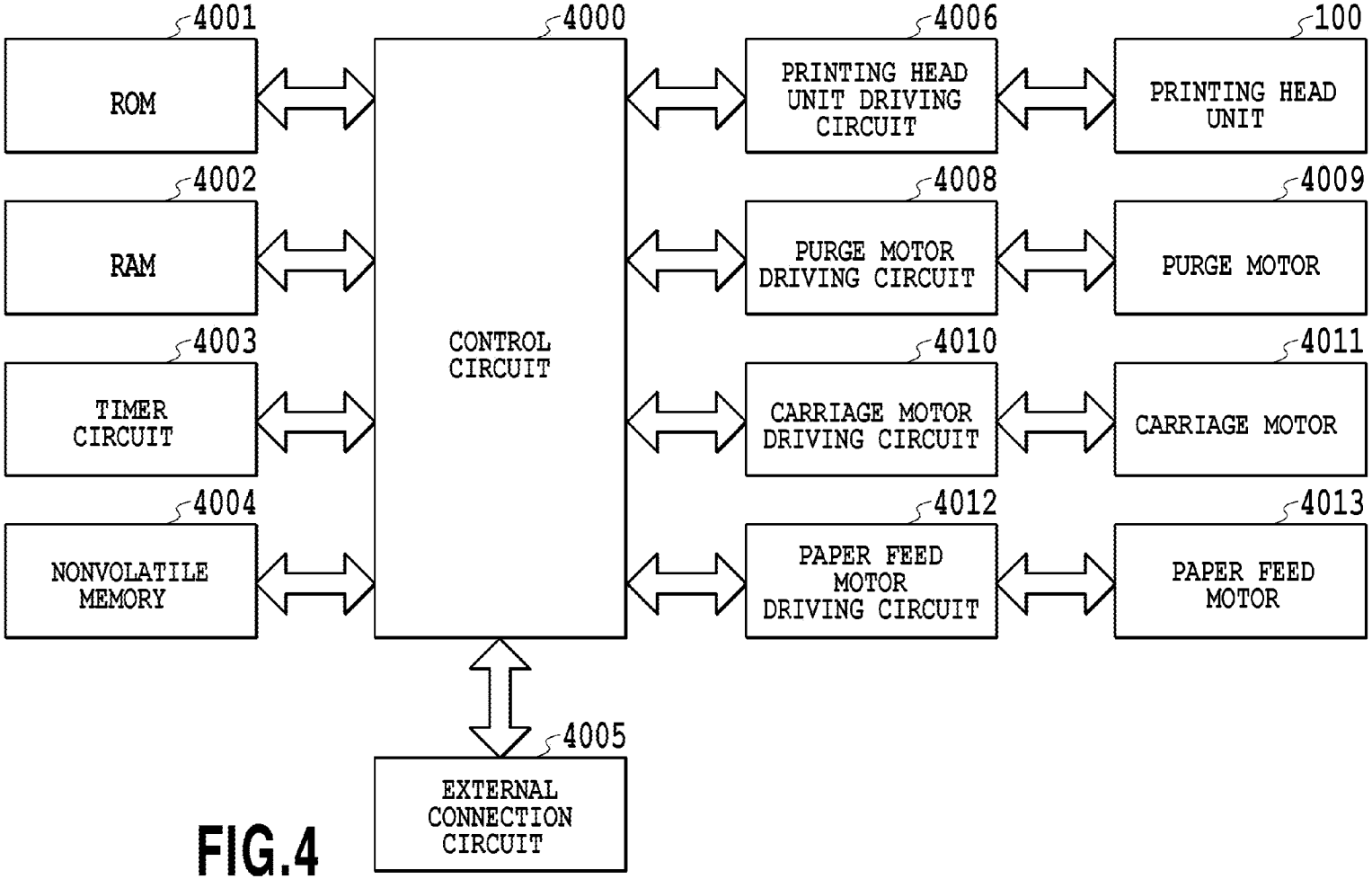
FIG. 4 is a block diagram illustrating the control configuration of the printing apparatus shown in FIG. 1.

FIG. 4 is a block diagram illustrating the control configuration of the printing apparatus shown in FIG. 1. In the drawing, the ROM 4001 stores therein the respective set values in a control program and a control executed in the apparatus of this embodiment. The RAM 4002 temporarily stores data of printing data, a control instruction, and control variables in the respective controls processed when the above control program is executed. A timer circuit 4003 acquires the current time or measures the elapsed time. A nonvolatile memory 4004 is used to written thereto and read therefrom time of certain control timing and stores therein the result of determining whether or the ink filling operation of this embodiment is carried out or not, for example.

The control circuit 400 executes a control program stored in the above-described ROM 4001 or a control program developed in the RAM 4002. The processing for the ink amount control of the main tank which will be described later is one of the control programs and is executed by the control circuit 4000.

An external connection circuit 4005 is a circuit that can be used by the control circuit 4000 as an interface and a control signal to perform communication between the printing apparatus of this embodiment and an external host apparatus in a wired or wireless manner. Via the external connection circuit 4005, an image data to be printed is inputted. The control circuit 4000 develops this received image data in the RAM 4002. The control circuit 4000 is configured, based on the data on the RAM 4002, to control the driving of the print head unit 100 via the print head unit driving circuit 4006 and to control the driving of the carriage motor 4011 via the carriage motor driving circuit 4010. By the control for the print head unit 100 and the carriage motor 4011, ink is ejected to a desired position on a print medium. The control circuit 4000 can control the conveying motor 4013 via the conveying motor driving circuit 4012 to thereby convey a print medium by a predetermined amount during a printing operation. In an ink filling operation according to one embodiment of the present invention which will be described later, the control circuit 4000 controls, via a purge motor driving circuit 4008, a purge motor 4009 for driving a tube pump.

Figure 5:
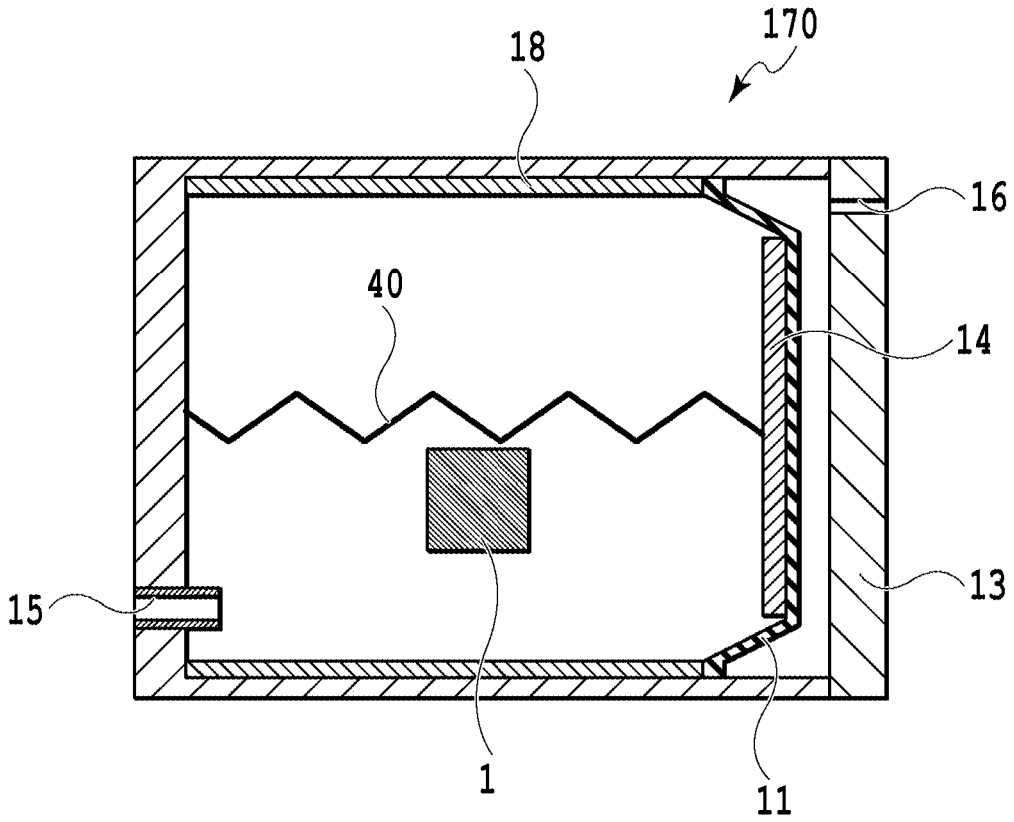
FIG. 5 is a cross-sectional view illustrating a main tank 170 shown in FIG. 2.

FIG. 5 is a cross-sectional view illustrating the main tank 170 shown in FIG. 2. As shown in FIG. 5, the main tank 170 has a containing portion having an ink containing space formed by a movable member 11, a frame 18, and an outer case 13. The movable member 11 is obtained by molding a deformable and flexible film to have a convex shape. A plane forming the top of the convex shape is attached with a plate 14, thereby allowing the peripheral edge of the top of the convex shape to be deformable. The containing space includes therein a spring 4 one end of which is attached to the plate 14 and the other end of which is fixed to a wall face also functioning as the outer case 13. This allows, when the ink amount is reduced in the containing portion, the movable member 11 to deform such that the negative pressure of the containing space is balanced with the elastic force by the spring 40. In the embodiment, a volume of the containing space is 10000 $mm^2$. Further, the main tank 170 includes, at apart of the outer case thereof, a supply opening 15 for supplying stored ink to the sub tank and an air introduction opening (bubbler) 1 for introducing air from the exterior when a predetermined negative pressure is reached relative to the external air pressure. The air introduction opening 1 includes thereon meniscus so that no gas is introduced until a predetermined negative pressure is reached. This consequently can suppress an increase of a negative pressure in the containing space due to ink consumption, thus preventing a defective ejection.

Figure 6:
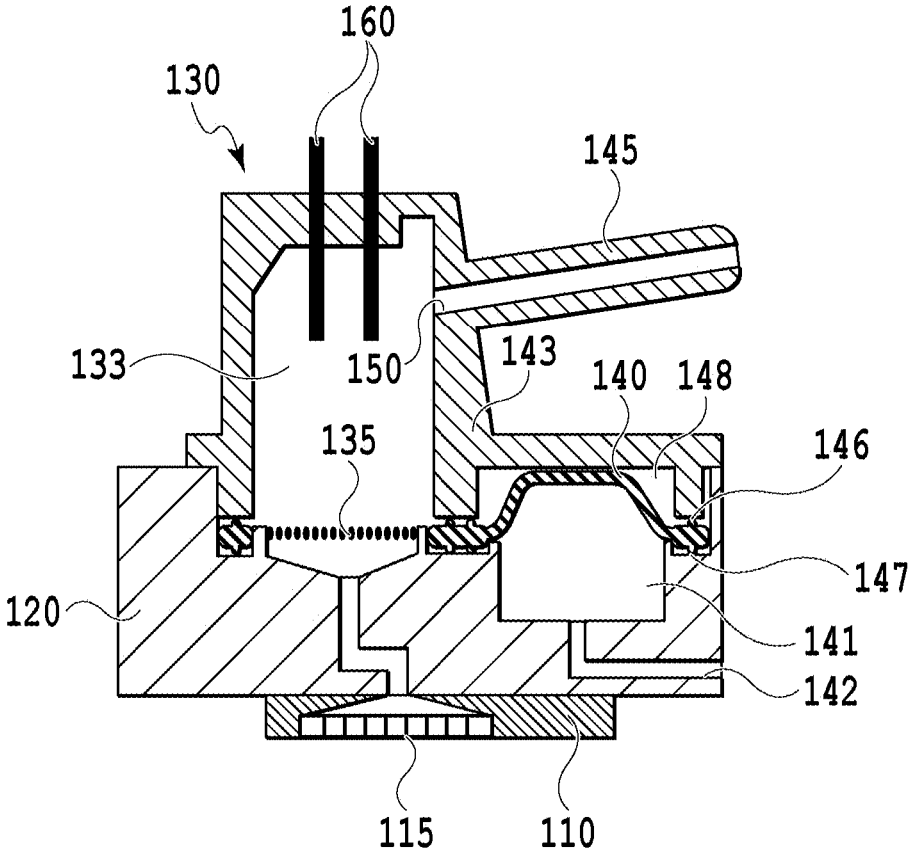
FIG. 6 is a schematic cross-sectional view mainly illustrating the configuration of a sub tank 130 according to one embodiment of the present invention.

FIG. 6 is a schematic cross-sectional view mainly illustrating the configuration of the sub tank 130 according to the embodiment. The lower part of the sub tank 130 is connected to the print head 110. Specifically, the print head 110 includes a liquid chamber 115 having an ejection heater for each ink ejection opening and is attached to the lower side of the tank retaining member 120 in which the sub tank 130 is formed. An ink supply opening commonly provided for the plurality of liquid chambers 115 of the print head 110 communicates with the filter 135 (joint chamber 133) of the sub tank 130 via an ink path formed in the tank retaining member 120. The tank retaining member 120 has a decompression chamber 141 communicating with the tube pump of the pump unit 300 via the decompression opening 142. The decompression chamber 141 includes a flexible member 140 that can be deformed depending on the pressure of the decompression chamber 141. One side of the flexible member 140 is fixed between the tank retaining member 120 and the sub tank forming member 143 via seal members 146 and 147. This consequently seals the decompression chamber 141 and the ink chamber 148 from the exterior of the sub tank 130. The other end side of the flexible member 140 is configured so that the ink chamber 148 communicates with the joint chamber 133 by providing the flexible member 140 between the sub tank forming member 143 and tank retaining member 120 via a plurality of spacers having an interval thereamong, thereby forming the communication part 149. As will be detailed later, by the displacement of the flexible member 140 in the decompression chamber 141, an ink filling operation of ink from the main tank 170 to the sub tank 130 can be performed.

The joint chamber 133 of the sub tank 130 at the upper side of the tank retaining member 120 has a pair of electrode pins 160. This provides, depending on whether the ink liquid level is higher or lower than the tip of the pin, the determination as to whether the ink amount in the sub tank is lower than a predetermined amount or not. Specifically, if a pair of electrode pins 160 have therebetween a voltage V1 higher than a threshold value A, the ink liquid level of the sub tank 130 (the joint chamber 133) is lower than the tip end of the electrode pin 160, thus detecting that the ink amount is smaller than a predetermined amount. The joint chamber 133 of the sub tank 130 includes a not shown ink path formation member (shown by the reference numeral "137" in FIG. 8 for example) which forms an ink path for an ink filling operation described later. Furthermore, the joint chamber 133 of the sub tank 130 includes a supply pipe 145 having an inflow opening 150 at the predetermined height. One side of this supply pipe 145 can be engaged with the supply opening 15 of the main tank 170. This allows the ink in the main tank 170 to be moved into the sub tank 130 via the inflow opening at the tip end of the supply pipe 145. In a normal printing operation, the ink in the joint chamber 133 of the sub tank 130 is reduced depending on the ink ejection operation of the print head 110. A change of the water head depending on this decrease is used to supply the ink from the main tank 170 to the sub tank 130 via the supply pipe 145 and the supply opening 15. In this embodiment, it is assumed that the joint chamber 133 has a cross-sectional area of $100^{=2}$, the volume from the filter 135 to the lower end of the electrode pin 160 is $1500^{=3}$, and the volume from the lower end of the electrode pin 160 to the inflow opening 150 is $300^{=3}$.

Figure 7:
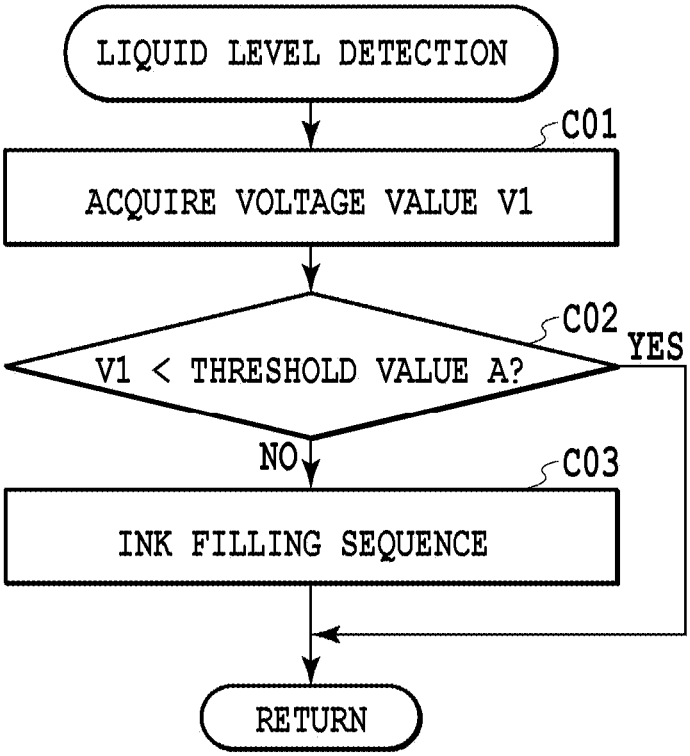
FIG. 7 is a flowchart illustrating a liquid level detection processing for sensing the amount of ink in the sub tank according to one embodiment of the present invention.

FIG. 7 is a flowchart illustrating a liquid level detection processing for detecting the ink amount of the sub tank according to one embodiment of the present invention. First, in Step C01, the voltage value V1 between the electrode pins 160 of the sub tank is acquired. Next, in Step C02, the acquired voltage value V1 is compared with the threshold value A. When the voltage value V1 is equal to or higher than the threshold value A, the processing in Step C03 determines that the ink amount of the sub tank (liquid level) is lower than the predetermined amount (or is positioned at a lower side of the tip end of the electrode pins 160) to thereby execute a filling sequence. On the other hand, when the voltage value V1 is lower than the threshold value A, this processing is completed. As described above, when the ink amount of the sub tank is lower than the predetermined amount, an operation is performed to supply ink from the main tank 170 to the sub tank 130.

Figure 8:
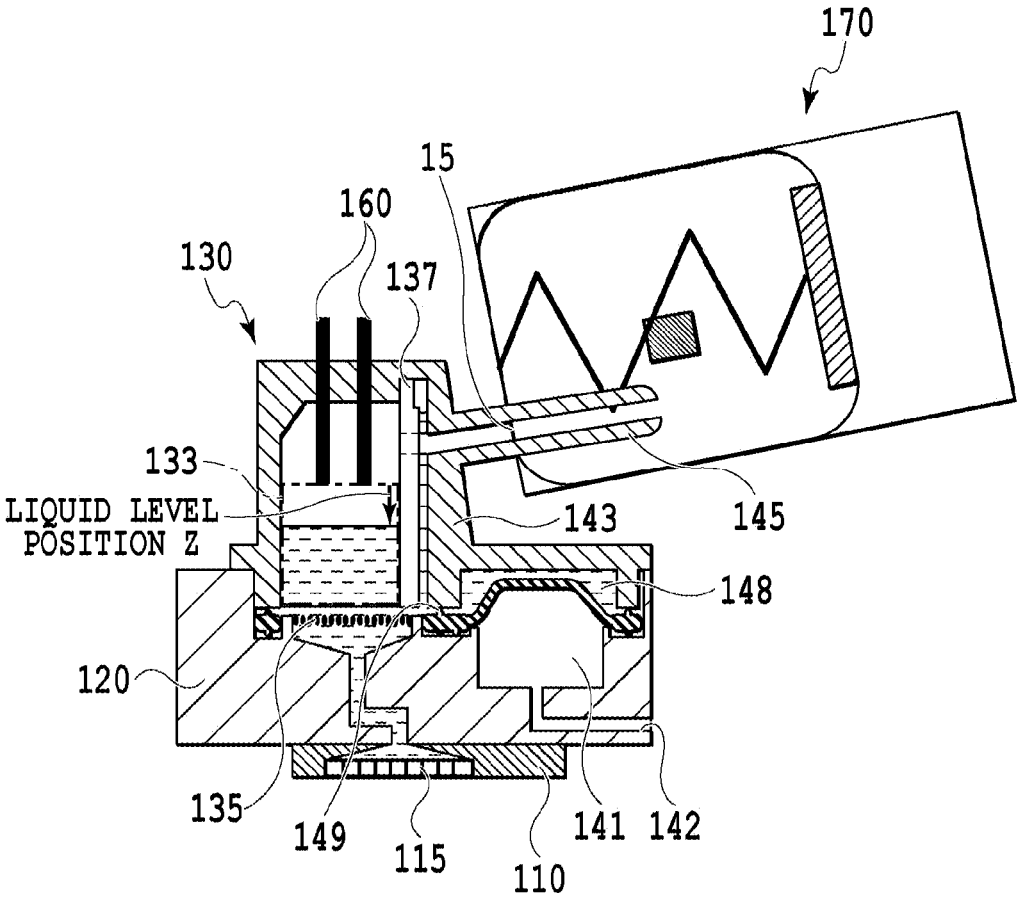
FIG. 8 is a view illustrating the state of the liquid level detection processing when the processing shown in FIG. 7 determines that the ink amount is lower than a predetermined amount.

FIG. 8 is a view illustrating the state of the sub tank when the processing shown in FIG. 7 determines that the ink amount is lower than the predetermined amount. As shown in FIG. 8, the main tank 170 is configured so that the supply pipe 145 of the sub tank 130 is inserted to the supply opening 15 to thereby allow the ink storage chamber of the main tank to communicate with the interior of the sub tank. In FIG. 8, the liquid level position Z is assumed so that the lower end of the electrode pin 160 is an origin and the lower direction in a vertical direction is defined as a + direction. As shown in FIG. 8, the joint chamber 133 includes the ink path formation member 137. The ink path formation member 137 and the sub tank forming member 143 have therebetween an ink path having substantially the same width as the diameter of the supply pipe 145 that is formed in the longitudinal direction of the joint chamber 133. At the same position as that of the opening of the supply pipe 145, a hole communicating with the joint chamber 133 is provided.

Figure 9:
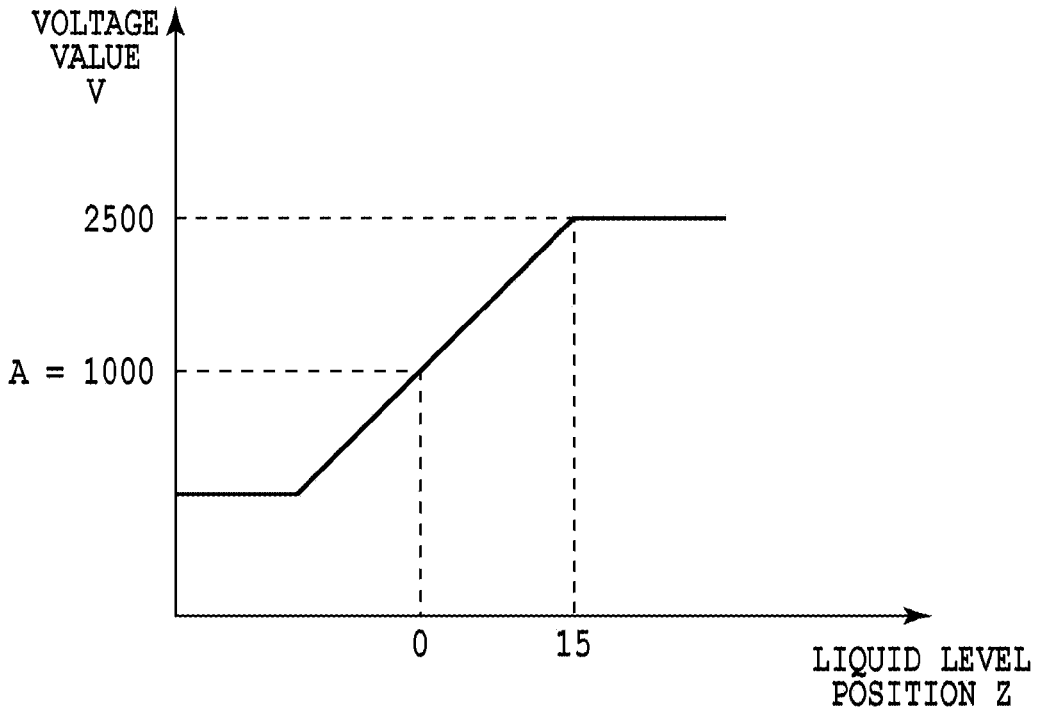
FIG. 9 is a graph illustrating a graph illustrating a liquid level position Z and a voltage value V between electrode pins 160 illustrated in FIG. 8.

FIG. 9 is a graph illustrating a relation between the liquid level position Z illustrated in the FIG. 8 and the voltage value V between the electrode pins 160. Even when the position of the liquid level is lower than the lower end of the pins, ink is cross-linked and conductive between the electrode, thus allowing the voltage value V to gradually increase relative to the liquid level position Z. In this embodiment, the relation between the voltage value V and the liquid level position Z is as shown below when Z=0 to 15 mm is established.

$$V=100\times Z+1000$$

Then, the voltage value 1000 mv during a state in which the liquid level position at the lower end of the pins (Z=0 mm) is set to the threshold value A for liquid level detection.

Figure 10:
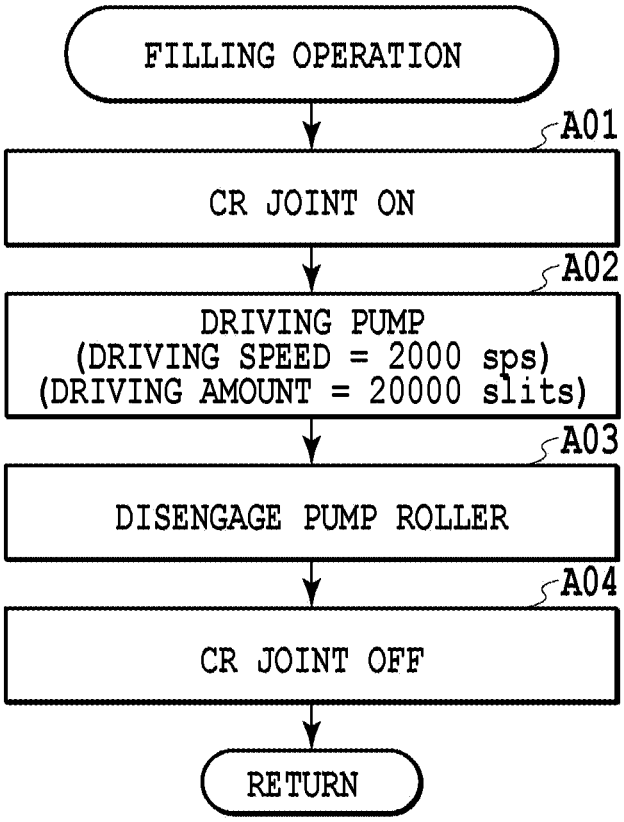
FIG. 10 is a flowchart illustrating the ink filling operation to the sub tank according to one embodiment of the present invention.
Figure 11A:
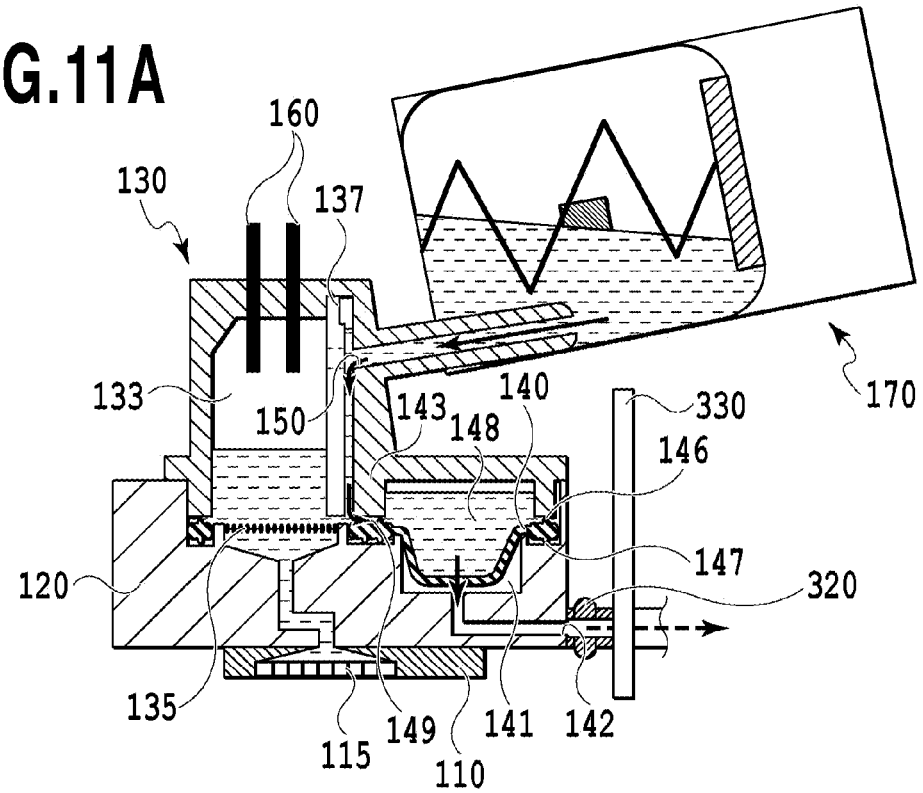
FIGS. 11A and 11B are views illustrating the ink filling operation to the sub tank.
Figure 11B:
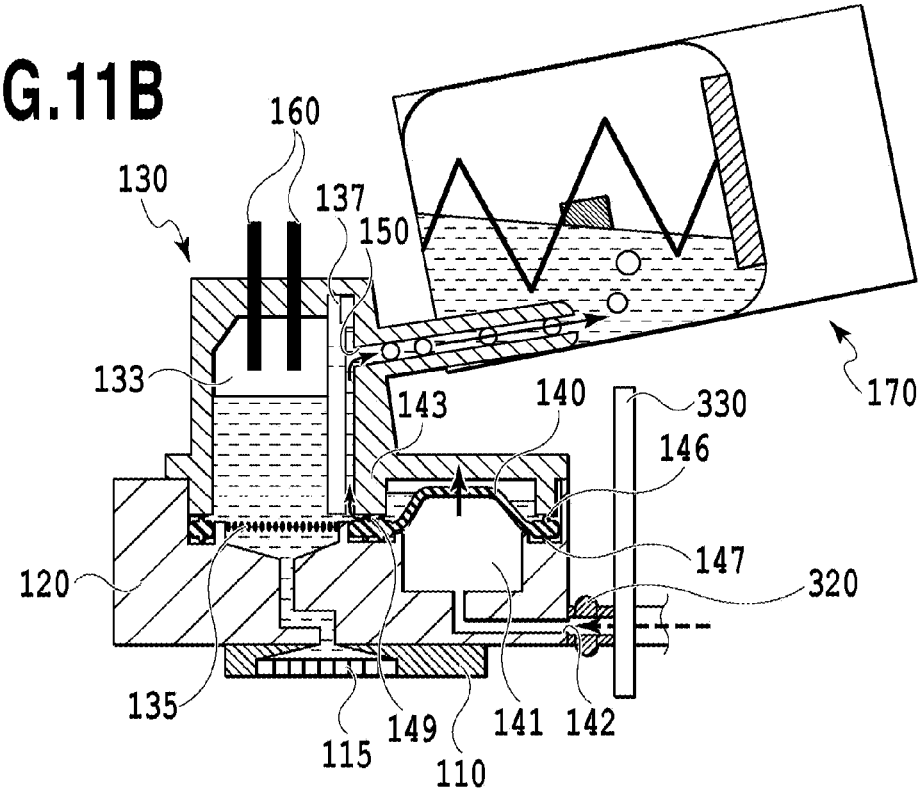

FIG. 10 is a flowchart illustrating the ink filling operation to the sub tank performed in Step C03 of FIG. 7 for example. FIGS. 11A and 11B are views illustrating the ink filling operation to the sub tank.

First, in Step A01, the carriage 340 is moved to one end of the inkjet printing apparatus 10 (the position shown in FIG. 1). This causes the suction pad 320 connected to the guide unit 330 to be contacted to the decompression opening 142 in the tank retaining member 120 for retaining the sub tank 130. Next, in Step A02, tube pump is driven at predetermined drive speed and drive amount to thereby reduce pressure in the decompression chamber 141 of the sub tank. As a result, the flexible member 140 is deformed as shown in FIG. 11A so as to be moved toward the decompression chamber. This consequently causes the ink in the main tank 170 to be introduced to the ink chamber 148 through the above-described ink path of the ink path formation member 137.

Next, in Step A03, the squeezing by the roller of the tube pump is released to thereby allow the decompression chamber 141 to communicate with air. This causes, as shown in FIG. 11B, the flexible member 140 to move toward the ink chamber 148. This movement causes the ink in the ink chamber 148 to move through both of the ink path of the ink path formation member 137 and the communication part 149 communicating with the joint chamber 133 to reach the respective parts. The ink path of the ink path formation member 137 is configured to have a higher resistance than that of the communication part 149. Thus, the above movement of the flexible member 140 causes more ink to be moved to the joint chamber 133 and the joint chamber 133 is filled with ink. During this, the ink liquid level upwardly moves mainly in the joint chamber 133 to thereby change the air in the joint chamber 133 into bubbles via the supply pipe 145 and the bubbles are discharged to the main tank. In this embodiment, an amount of ink filled by a single filling operation is $100=^{3}$ (minimum value of tolerance) and the time required to perform a single filling operation is 10 seconds.

Figure 12:
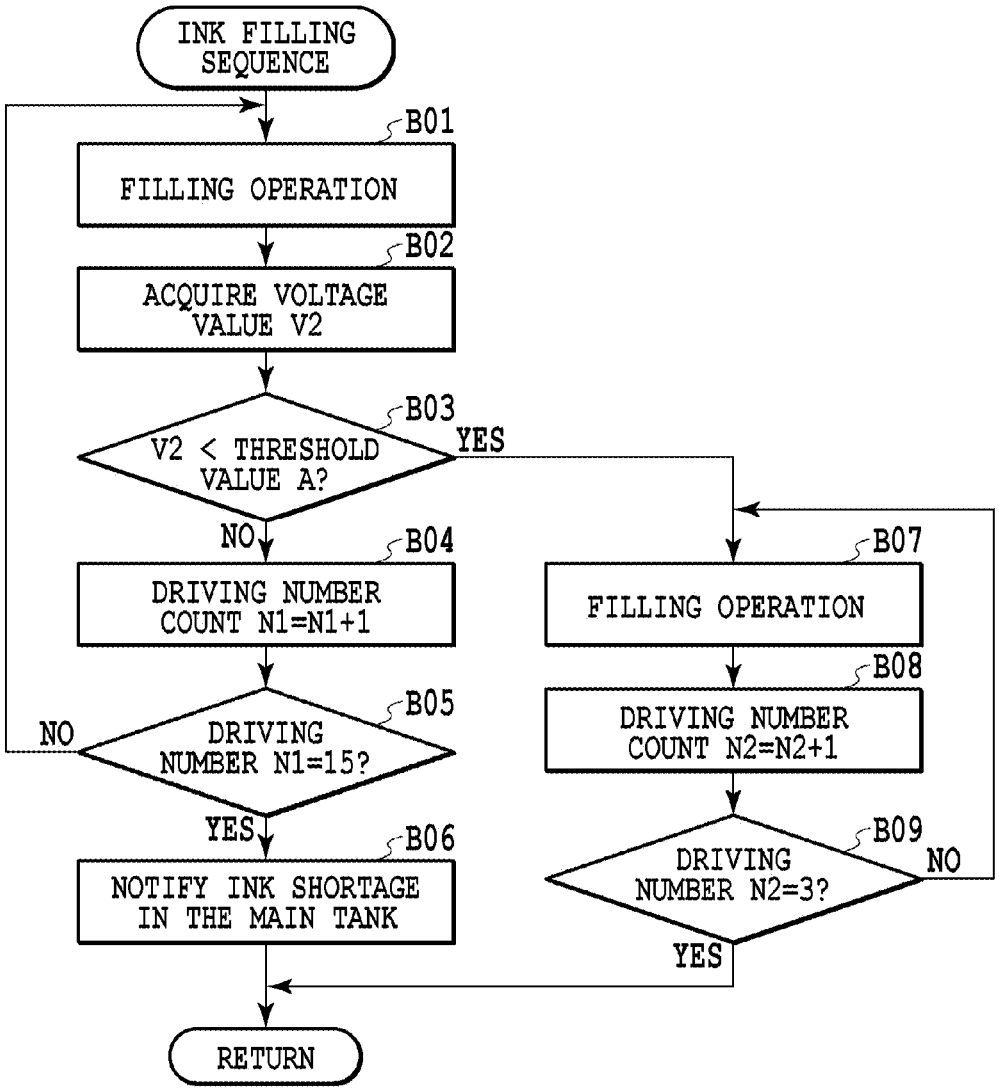
FIG. 12 is a flowchart illustrating an ink filling operation according to a comparison example of the present invention.

FIG. 12 is a flowchart illustrating the ink filling operation according to a comparison example. First, in Step B01, the ink filling operation described above with reference to FIG. 10 and FIGS. 11A and 11B is performed one time. Next, in Step B02, the voltage value V2 between a pair of electrode pins 160 is acquired. In Step B03, the voltage value V2 is compared with the threshold value A. When the voltage V2 is equal to or higher than the threshold value A, i.e., when the amount of ink in the sub tank 130 is lower than the predetermined amount, the driving number N1 is counted up in Step B04. In Step B05, whether the driving number N1=15 is reached or not is determined. When the driving number N1 is lower than 15, the processing returns to Step B01 and the subsequent steps are repeated. When N1=15 is reached on the other hand, in Step B06, a user is notified of the fact that there is ink shortage in the main tank 170. Specifically, even when the ink filling operation is performed 15 times, the amount of ink in the sub tank 130 not reaching the predetermined amount is determined as that there is no ink sufficient to fill the main tank 170. This driving number is set assuming that the main tank is just exchanged and is set so as to fill the sub tank with ink in a range from the filter to the lower end of the electrode pin. In this embodiment, the volume from the filter 135 of the sub tank 130 to the lower end of the pin 160 is 1500 $mm^3$ and one filling amount is 100 $mm^3$ and thus the driving number is set to 1500+100=15.

On the other hand, when the liquid level of the sub tank is detected during the above 15 filling operations, an additional filling operation is performed to fill the sub tank with ink in a range from the lower end of the electrode pin 160 to the inflow opening 150. Specifically, when Step B03 results in that the voltage value V2 is lower than the threshold value A, the filling operation is performed in Step B07. Next, in Step B08, the driving number N2 is counted up. In Step B09, whether the driving number is N2=3 or not is determined. When N2 is lower than 3, the processing returns to Step B07 to repeat the subsequent steps. Specifically, the additional filling after the liquid level is detected is repeated three times and is then completed. This driving number is set so that the sub tank can be filled with ink in a range from the lower end of the electrode pin to the inflow opening. In this embodiment, the volume from the lower end of the electrode pin to the inflow opening is 300 $mm^3$ and one filling amount is 100 $mm^3$ and thus the additional driving number is set to 300+100=3.

Figure 13A:
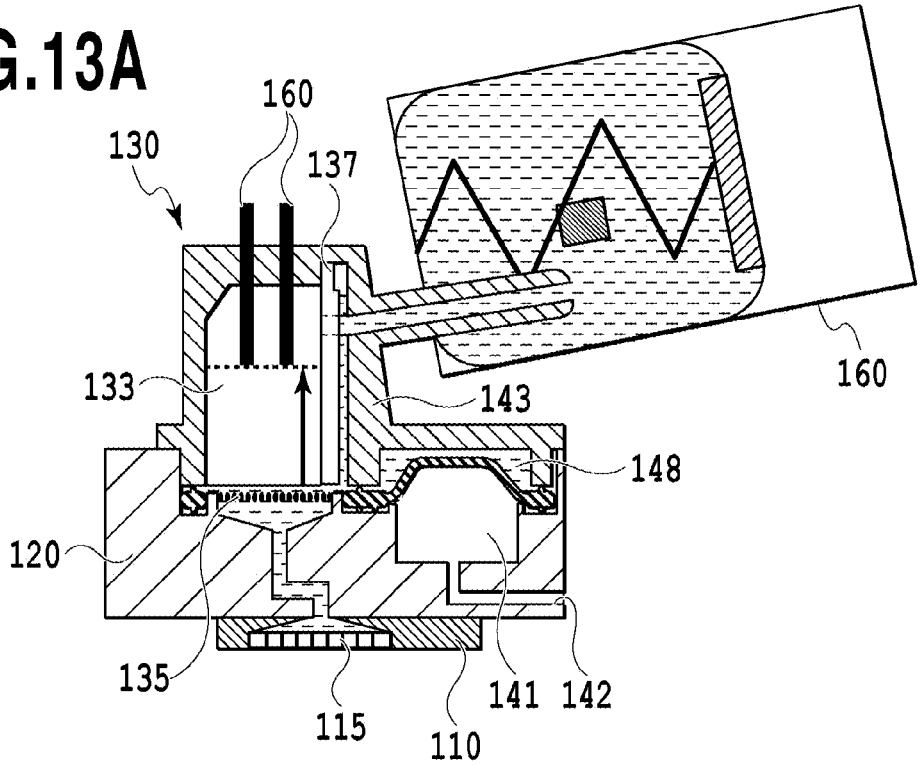
FIGS. 13A and 13B are views illustrating the ink states of the sub tank and the main tank depending on the timing of the ink filling operation from the main tank to the sub tank.
Figure 13B:
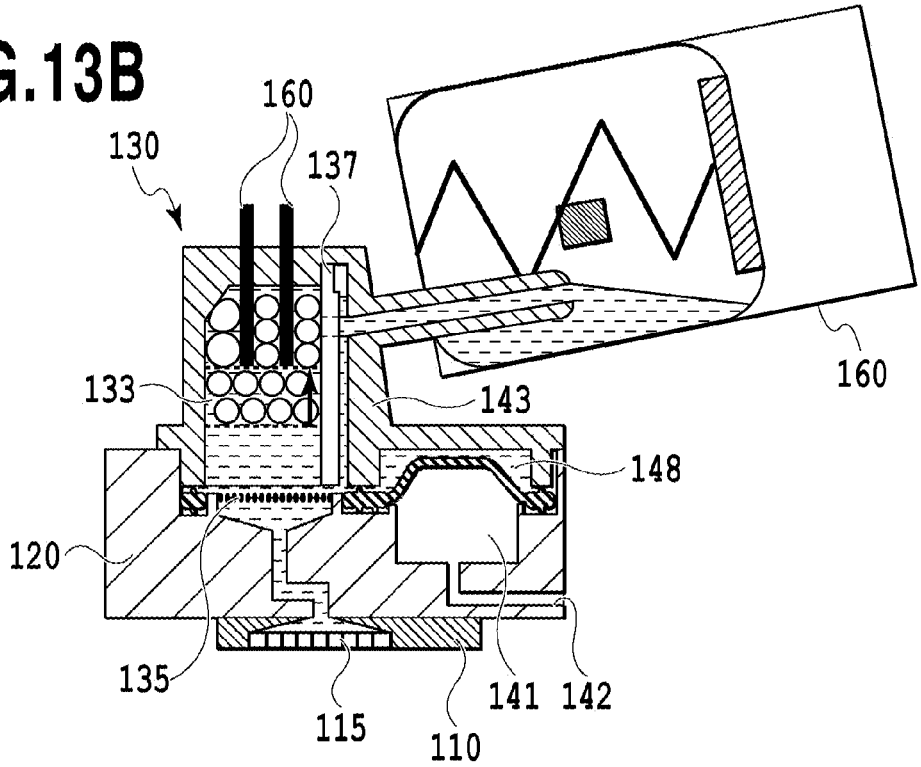

In the case of the ink filling operation of the comparison example described with reference to FIG. 12, an unnecessary ink filling operation is performed as described above, thus causing a disadvantage of a proportional increase of the time required to determine that there is ink shortage in the main tank. Specifically, the ink filling operation is performed at timing just after the exchange of the main tank and at timing of a state in which the amount of ink remaining in the main tank is lower than a predetermined amount (also may be referred to as a "used-up state"). FIG. 13A illustrates a state just after the exchange of the main tank in which ink shortage exists in the sub tank 130 and sufficient ink exists in the main tank 170. FIG. 13B on the other hand illustrates a state in which the ink in the main tank is used up and bubbles flows in the sub tank 130 and a small amount of ink exists in the main tank 170. The ink filling operation according to the comparison example described above with reference to FIG. 12 is suitable for a state as shown in FIG. 13A in which the main tank includes a sufficient amount of remaining ink. However, in a state as shown in FIG. 13B in which the main tank includes a small amount of remaining ink, 15 filling operations performed as in the case of a high remaining amount results in that ink is insufficiently filled through a single filling operation. Thus, 15 filling operations as a judgmental standard is relatively high. As a result, 10 seconds×15 times=150 seconds can be recognized as an unnecessarily-long time in the state shown in FIG. 13B.

Figure 14:
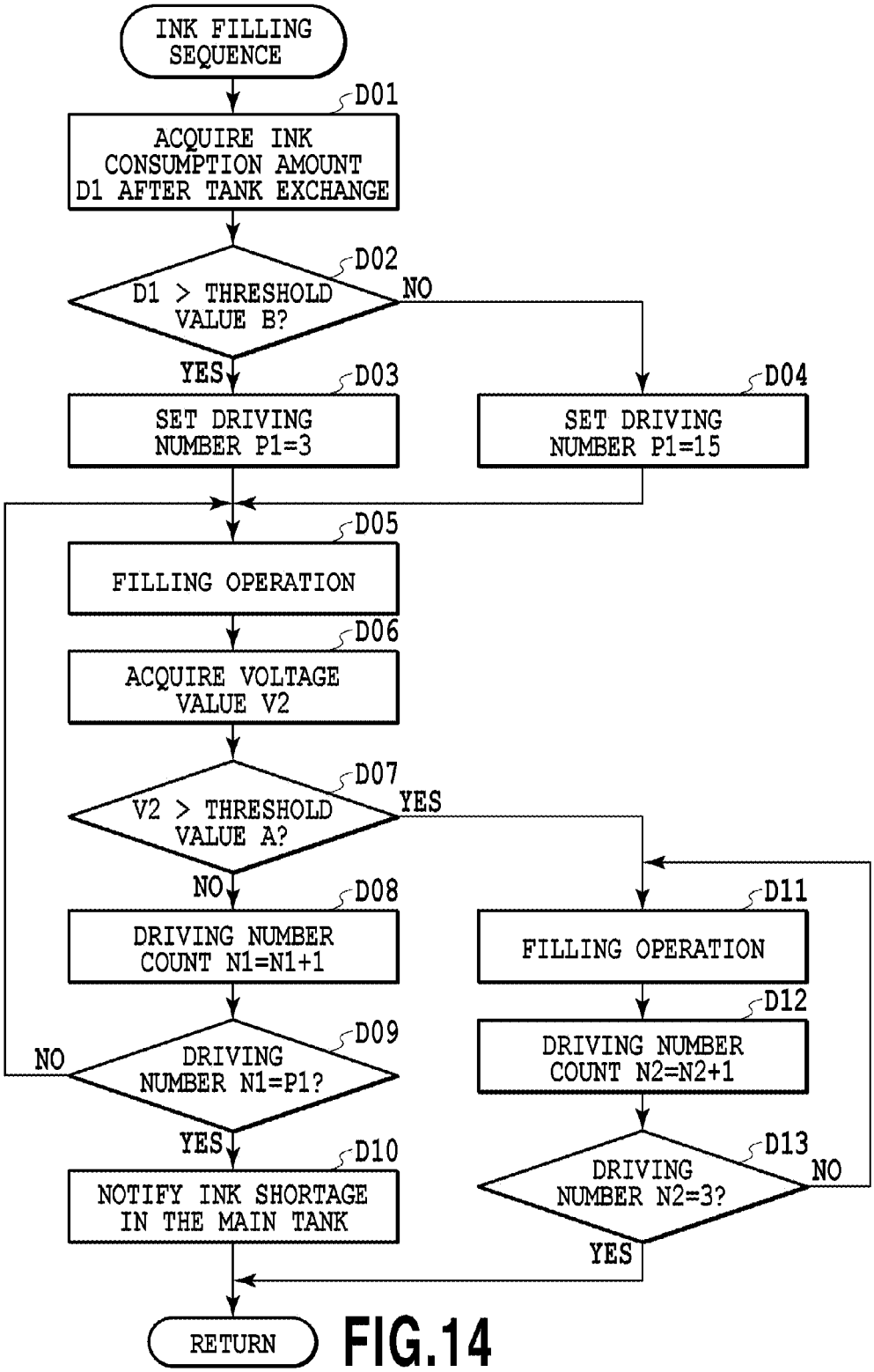
FIG. 14 is a flowchart illustrating the ink filling operation according to the first embodiment of the present invention.

FIG. 14 is a flowchart illustrating the ink filling operation according to the first embodiment of the present invention. In the first embodiment of the present invention, first, in Step D01, the ink consumption amount D1 after the tank exchange is acquired. In this embodiment, this ink consumption amount D1 has a value obtained by calculating the total of the number of ink droplets ejected through a print head, i.e., the ejection number through each nozzle, for the total of nozzles to multiply the total with the maximum ejection amount value. The ink consumption amount D1 is reset when the main tank is exchanged. Specifically, the ink amount of the main tank is acquired according to this embodiment as the above ink consumption amount. Next, in Step D02, the acquired ink consumption amount D1 is compared with the threshold value B. When the ink consumption amount D1 is higher than the value B, the driving number used as a judgmental standard for an ink filling operation is set to P1=3 (first ink filling operation). When the ink consumption amount D1 is equal to or lower than the threshold value B on the other hand, the driving number of the ink filling operation is set to P1=15 (second ink filling operation). The steps in Step D05 to Step D13 are similar to the steps of Steps B01 to B09 according to comparison example shown in FIG. 12 and thus will not be described further.

Figure 15:
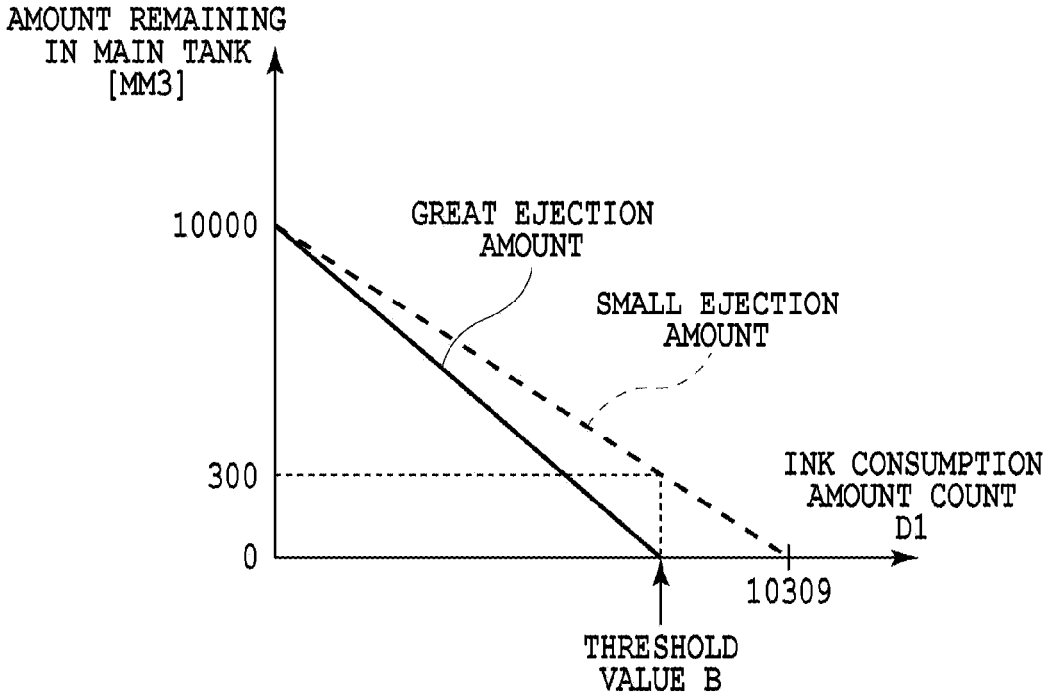
FIG. 15 is a diagram illustrating that the threshold value of the ink consumption amount shown in FIG. 14 is determined in consideration of a variation of the ink ejection amount.

As described above, according to one embodiment of the present invention, even after the ink filling operation is performed for the set P times (3 times or 15 times), if the liquid level of the sub tank cannot be detected, then the ink amount of the main tank can be determined as being lower than a predetermined remaining amount or there is no remaining amount. Specifically, if the liquid level of the sub tank cannot be detected even after a predetermined number of the filling operation is performed, the ink amount of the main tank can be detected as being lower than the predetermined remaining amount. In this case, if the liquid level of the sub tank cannot be detected, the driving number used as an ink filling standard is switched depending on the ink consumption amount after the exchange of the main tank. Specifically, when the acquired ink consumption amount is higher than the predetermined threshold value, it can be considered that the main tank includes therein a small amount of remaining ink. Thus, the driving number is set to a value lower than that when the ink consumption amount is lower than a threshold value. As a result, when the ink in the main tank is used up, only three filling operations are required as a standard, thus reducing the time to 10 seconds×3=30 seconds. The threshold value B of the ink consumption amount may be set to a threshold value by which a small amount of ink remaining in the main tank can be estimated. In this embodiment, as shown in FIG. 15, in consideration of the variation of the ejection amount, a count value 10000 mm showing a possibility of ink shortage in the main tank is set as the threshold value B. The driving number of the ink filling ink when the consumption amount D1 is equal to or higher than the threshold value B is set to a minimum number at which the ink filling can be expected. Specifically, since there is a possibility where 300 mm of ink remains in the main tank, the driving number is set to 300÷100=3 based on a single filling amount of 100=$^3$.

In this embodiment, since the driving number of the ink filling is set to 3 and 15. This invention is not limited to this number. The driving number may be 1 or more and two types of driving numbers may have therebetween a difference in the ink consumption amount as a standard. The driving number of the filling operation is switched depending on the ink consumption amount after the exchange of the main tank. However, other parameters also may be used. For example, the driving number may be switched depending on the ejection number after the exchange of the main tank or the number of printing operations after the exchange of the main tank.

In this embodiment, a liquid level is sensed using an electrode. However, another method also can be used to estimate the liquid level position. For example, the liquid level may be sensed using an optical sensor or a float sensor. In this embodiment, a common ink filling parameter is used among all colors. However, a different parameter may be used for each color. For example, a color corresponding to a high tank capacity may be subjected to increased driving number or threshold value B. Alternatively, a color having an ink property having a tendency of bubble generation may be subjected to increased driving number or threshold value B than in the case of a color causing a small amount of bubbles.

Second Embodiment

According to the first embodiment of the present invention, an ink filling operation is performed just after the liquid level is detected. However, according to the second embodiment of the present invention, when a small amount of ink remains in the main tank, an ink filling operation is performed after a printing operation.

Figure 16:
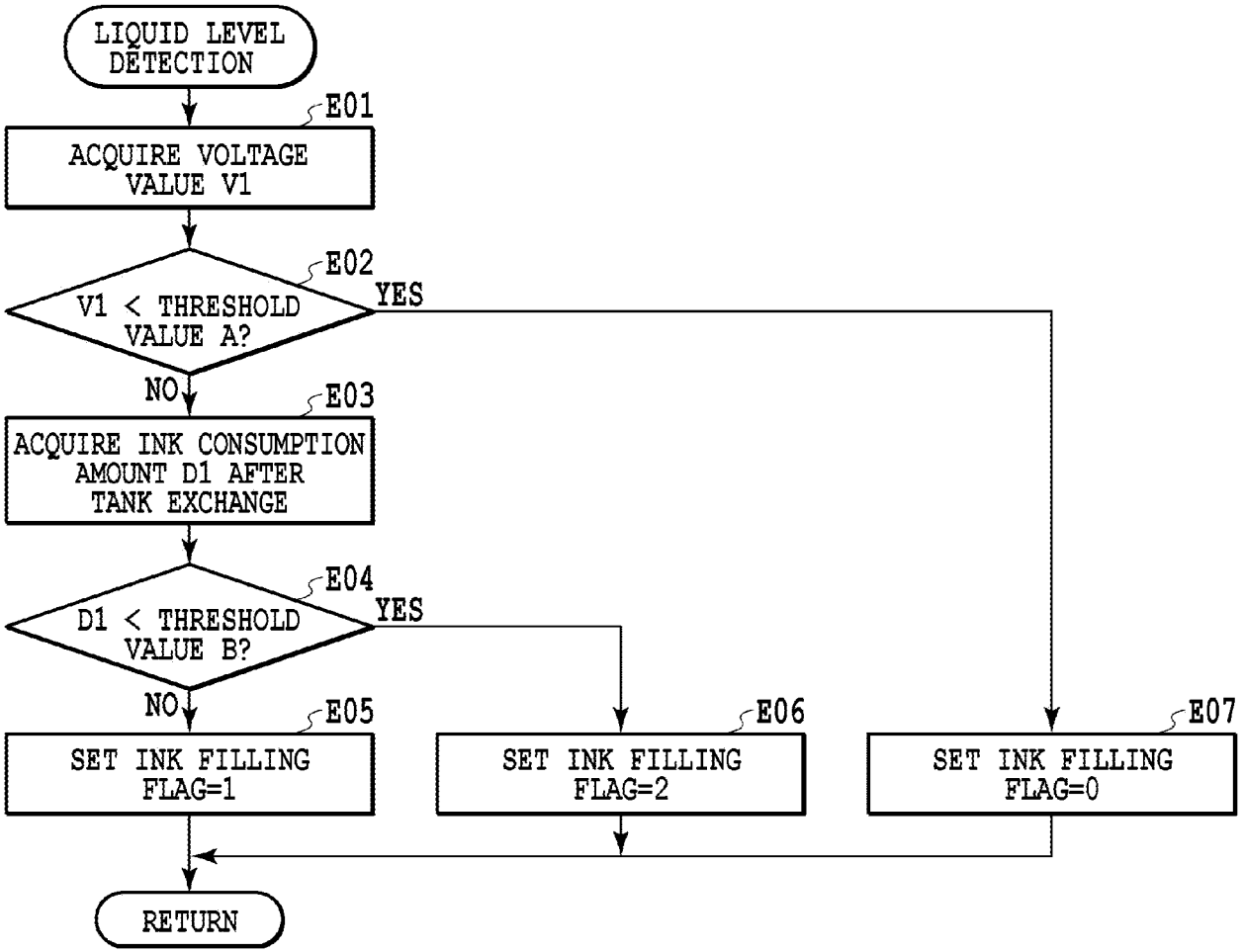
FIG. 16 is a flowchart illustrating a liquid level detection processing according to the second embodiment of the present invention.

FIG. 16 is a flowchart illustrating a liquid level detection processing according to the second embodiment of the present invention. First, in Step E01, the voltage value V1 related to the liquid level position of the sub tank is acquired. Next, in Step E02, whether the acquired voltage value V1 is lower than the threshold value A or not is determined. When the voltage value V1 is determined to be equal to or higher than the threshold value A (i.e., when the ink amount of the sub tank is equal to or lower than a predetermined amount), then the processing in Step E03 acquires the ink consumption amount D1 after the exchange of the main tank. Then, the processing in Step E04 determines whether the ink consumption amount D1 is lower than the threshold value B or not. When the ink consumption amount D1 is equal to or higher than the threshold value B, the processing in Step E05 sets an ink filling flag to 1. When the ink consumption amount D1 is lower than the threshold value B on the other hand, the processing in Step E06 sets the ink filling flag to 2. When the processing in Step E02 determines that the voltage value V1 is lower than the threshold value A, then the ink filling flag is set to 0.

Figure 17:
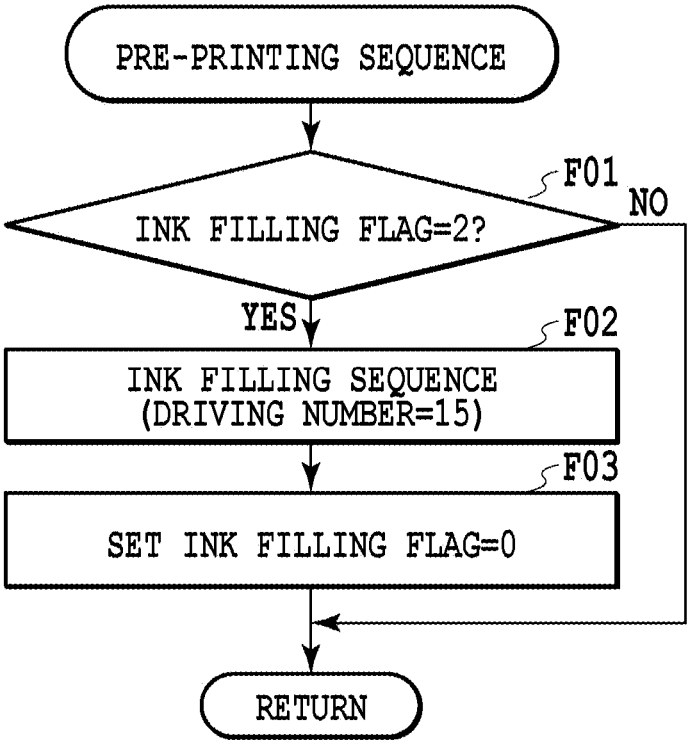
FIG. 17 is a flowchart illustrating a pre-printing processing in the inkjet printing apparatus according to the second embodiment.

FIG. 17 is a flowchart illustrating a pre-printing processing in the inkjet printing apparatus according to this embodiment. First, in Step F01, whether ink filling flag=2 is established or not is determined. When ink filling flag=2 is established, then the processing in Step F02 performs an ink filling operation having a standard driving number of 15. Specifically, when the main tank can be determined as including a sufficient amount of remaining ink, an ink filling operation is prioritized over a printing operation. On the other hand, when the ink filling flag=1 or 0, this processing is completed. Specifically, when the main tank can be determined as including a small amount of remaining ink, no ink filling is performed and a printing operation is prioritized.

Figure 18:
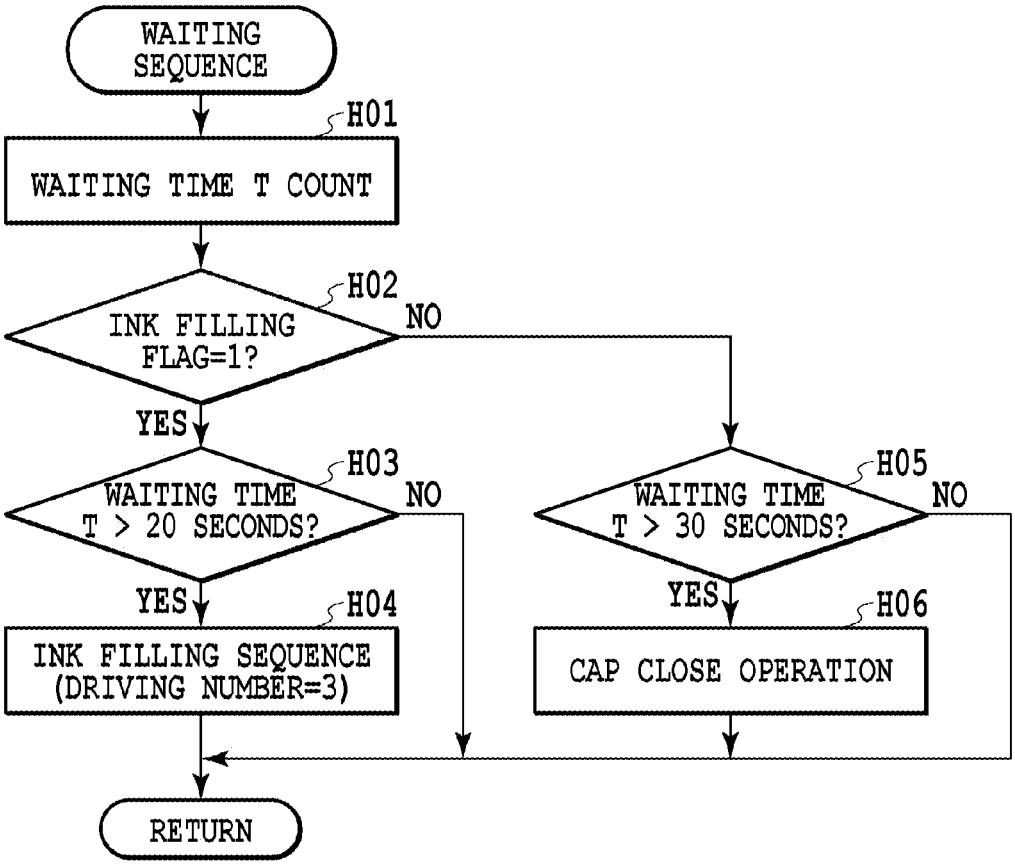
FIG. 18 is a flowchart illustrating a waiting processing in the inkjet printing apparatus according to the second embodiment.

FIG. 18 is a flowchart illustrating a waiting processing in the inkjet printing apparatus according to this embodiment. First, the processing in Step H01 counts the waiting time T after the completion of the printing operation. Next, the processing in Step H02 determines whether the ink filling flag=1 is established or not. When the ink filling flag=1 is established, the processing in Step H03 determines whether the waiting time T exceeds 20 seconds or not. When the waiting time T exceeds 20 seconds, an ink filling operation having the driving number of 3 is performed. Specifically, when it can be determined from the ink filling flag=1 that the main tank includes therein a small amount of ink, an ink filling operation is performed when 20 seconds has passed after the waiting state. When the processing in Step H02 determines that the ink filling flag=1 is not established, then the processing in Step H05 determines whether the waiting time T exceeds 30 seconds or not. When the waiting time T exceeds 30 seconds, the processing in Step H06 performs a cap close operation.

Figure 19:
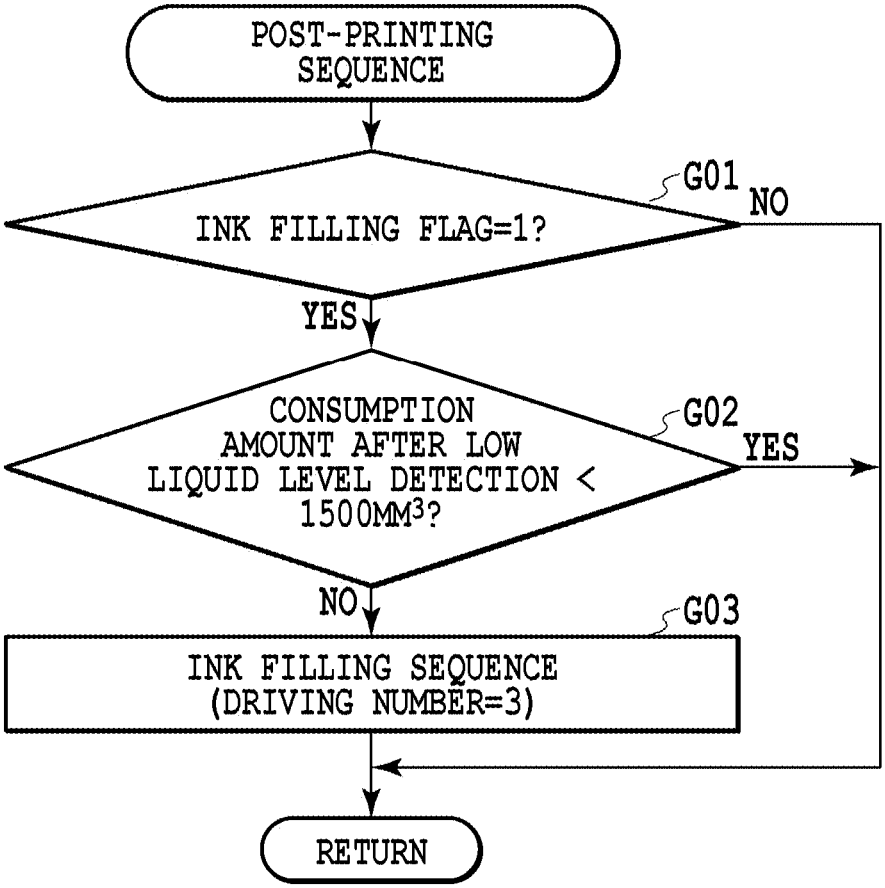
FIG. 19 is a flowchart illustrating a post-printing processing in the inkjet printing apparatus according to the second embodiment.

FIG. 19 is a flowchart illustrating a post-printing processing in the inkjet printing apparatus according to this embodiment. First, the processing in Step G01 determines whether the ink filling flag=1 is established or not. When the ink filling flag=1 is established, then the consumption amount after low liquid level is detected is lower than 1500=$^3$ or not is determined. When the consumption amount after no liquid level is sensed is equal to or higher than 1500 mm$^3$, then the processing in Step G03 performs an ink filling operation based on the driving number of 3. In this embodiment, the printing operation is performed in a prioritized manner over the ink filling operation. However, if the ink filling operation is performed too late, there is ink shortage in the sub tank to cause a risk of a defective ejection. Thus, if the consumption amount after no liquid level is sensed is equal to or higher than the threshold value, a filling operation is performed in a forced manner. In this embodiment, the volume of 1500 mm$^3$ from the filter to the lower end of the electrode pin is set as a threshold value.

As described above, according to this embodiment, the ink filling operation just after the exchange of the main tank is performed in a prioritized manner over the printing operation. The ink filling operation when the ink in the main tank is used up is performed in a prioritized manner over the printing operation. This can consequently reduce the waiting time during which a user has to wait when the ink in the main tank is used up.

Third Embodiment

According to the above-described first and second embodiments, the number at which a pump is driven for an ink filling operation is switched depending on the ink consumption amount. According to the third embodiment of the present invention, the amount of the pump driving is switched.

Figure 20A:
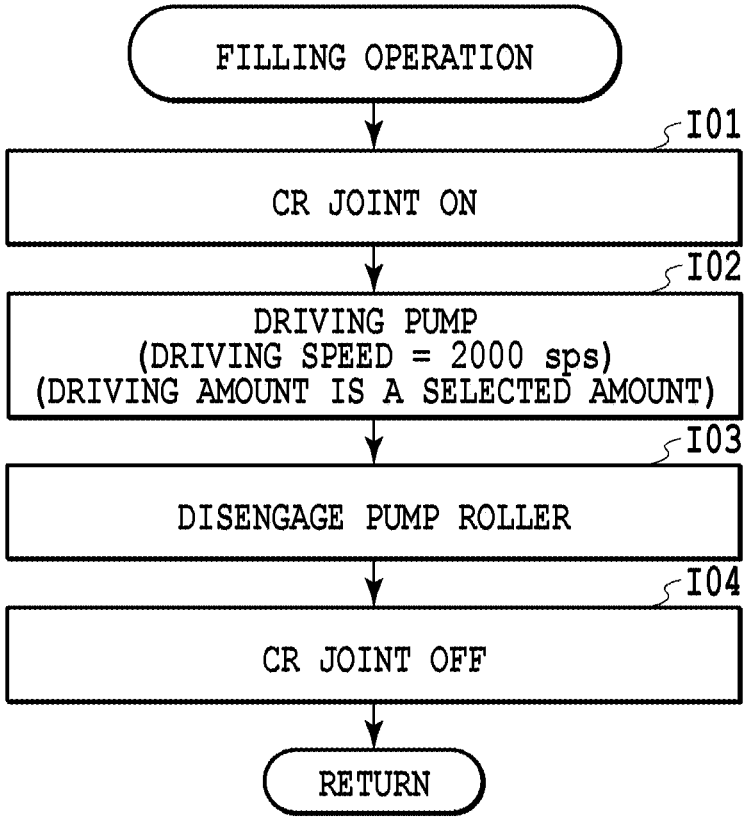
FIGS. 20A and 20B are a flowchart illustrating the ink filling operation and the ink filling processing according to the third embodiment of this embodiment, respectively.
Figure 20B:
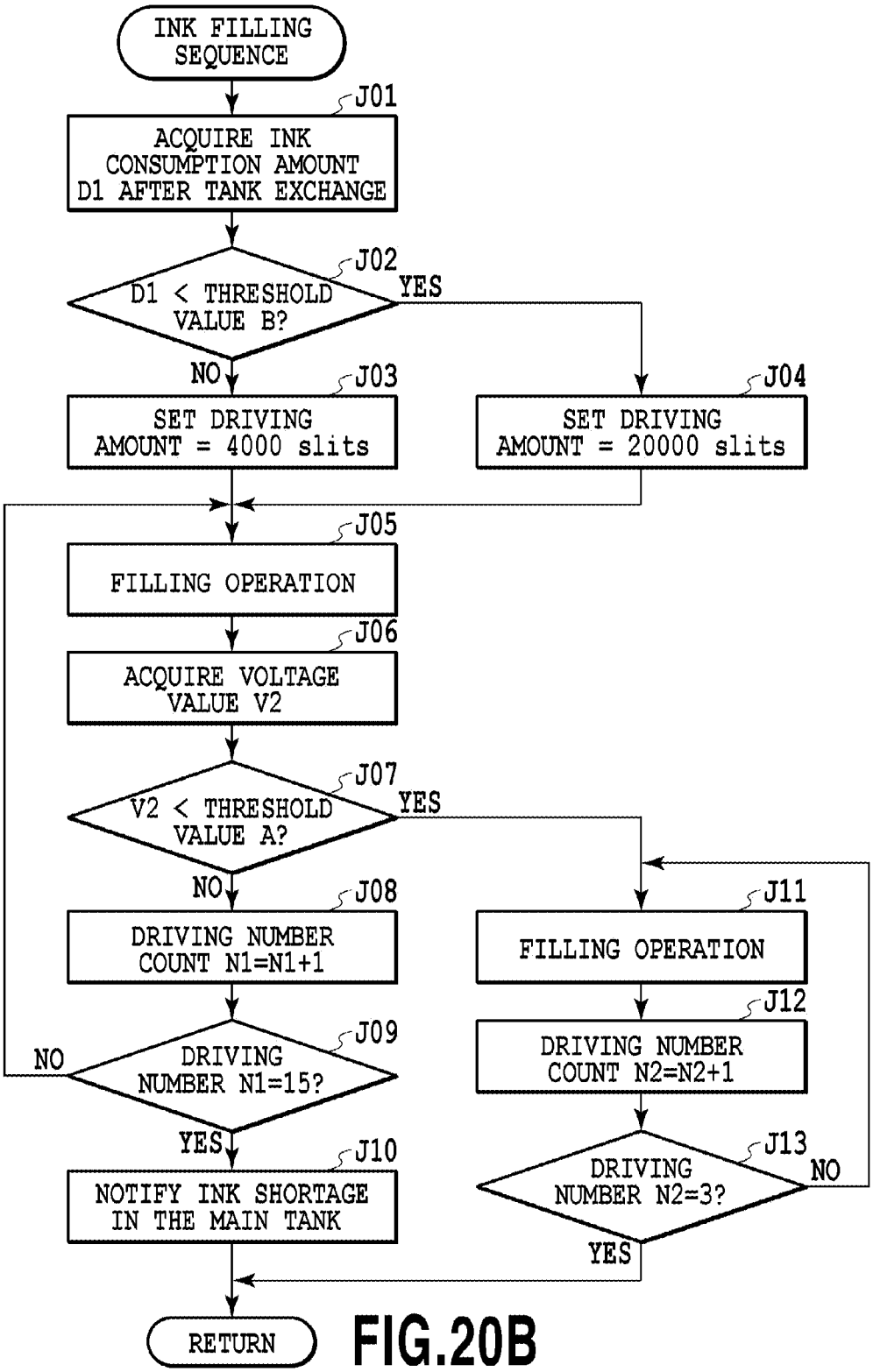

FIGS. 20A and 20B are a flowchart illustrating an ink filling operation and an ink filling processing according to the third embodiment of this embodiment, respectively. The operation shown in FIG. 20A is similar to that shown in FIG. 10 according to the first embodiment. The difference is that a driving parameter for the tube pump is different as described below.

Only the difference between the filling processing shown in FIG. 20B and the first embodiment is that, when the processing in Step J02 determines that the ink consumption amount D is equal to or higher than the threshold value B, the processing proceeds to Step J03 to set the driving amount to 4000 slits. When the ink consumption amount D is determined to be lower than the threshold value B on the other hand, the processing proceeds to Step J04 to set the driving amount to 20000 slits. The driving number is 15 regardless of the ink consumption amount and the driving speed is 2000 slits per second. Specifically, according to the ink filling processing in this embodiment, the driving amount when the ink in the main tank is used up is lower than that just after the main tank is exchanged. This can consequently reduce the waiting time during which a user has to wait when the ink in the main tank is used up.

Fourth Embodiment

According to the fourth embodiment of the present invention, the pump driving speed is switched depending on the ink consumption amount.

Figure 21A:
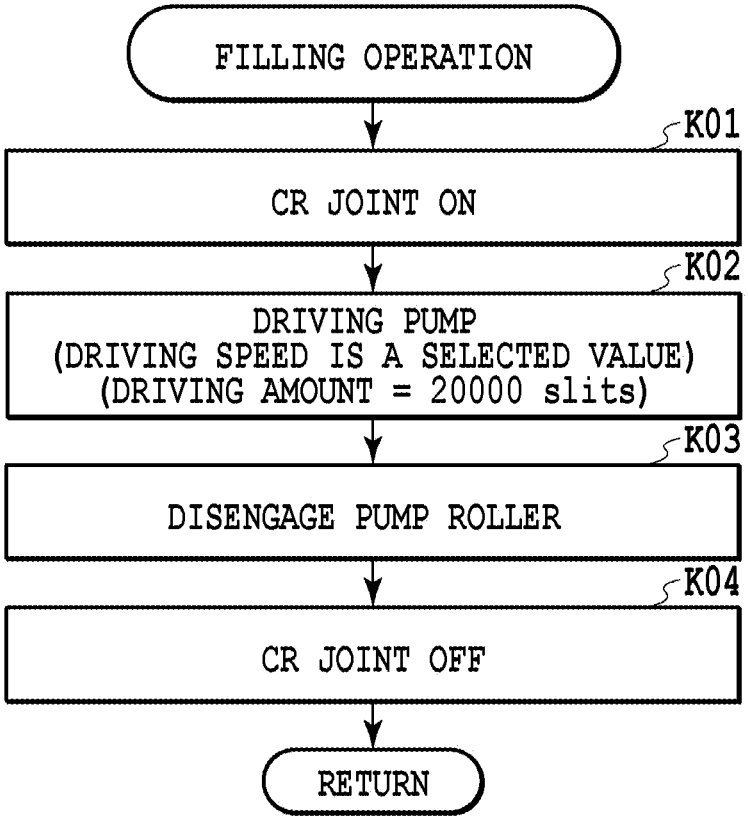
FIGS. 21A and 21B are a flowchart illustrating the ink filling operation and the ink filling processing according to the fourth embodiment of this embodiment, respectively.
Figure 21B:
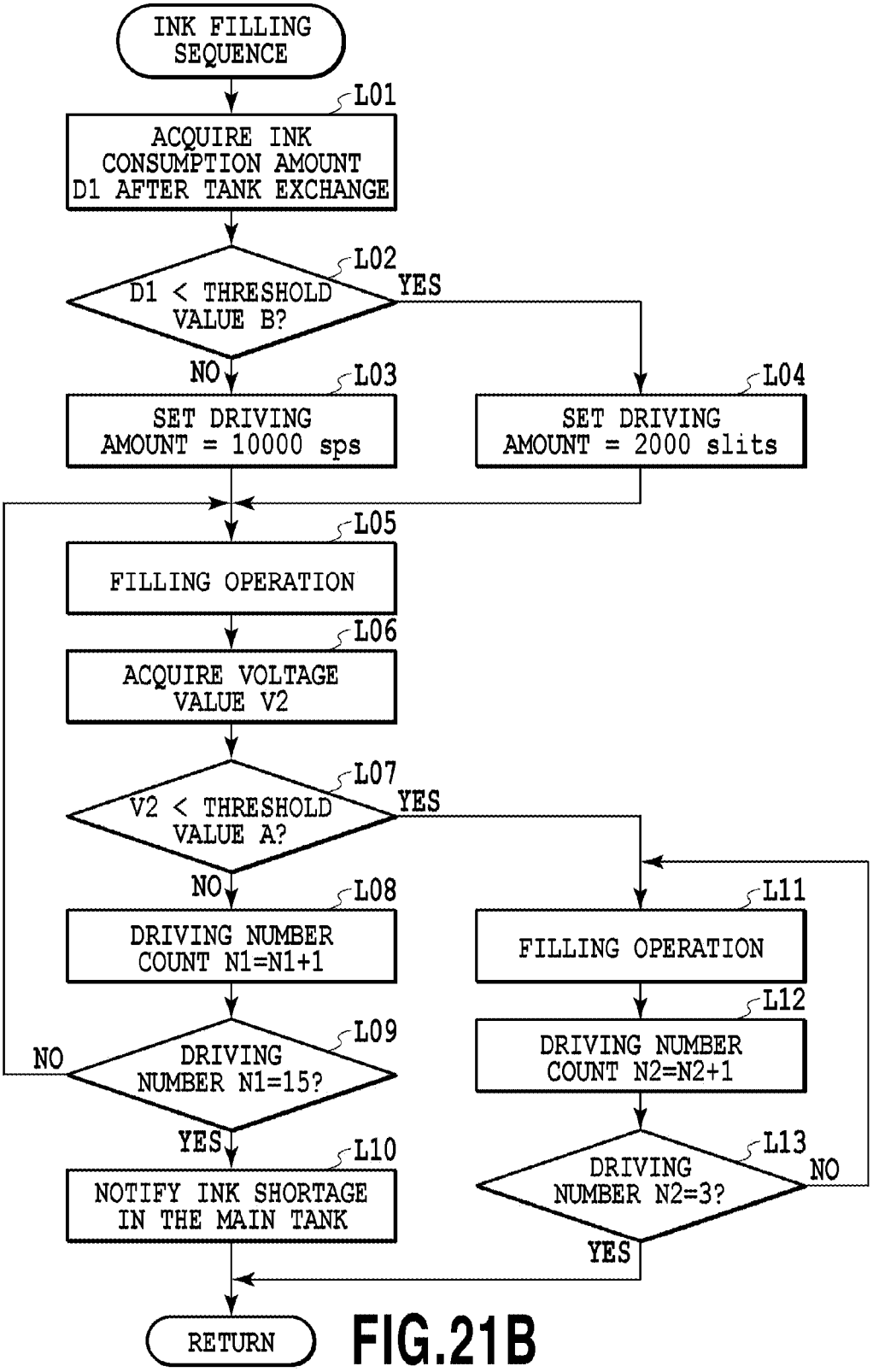

FIGS. 21A and 21B are a flowchart illustrating the ink filling operation and the ink filling processing according to the fourth embodiment of this embodiment, respectively. The operation shown in FIG. 21A is similar to that shown in FIG. 10 according to the first embodiment. The difference is that a different tube pump driving parameter is used as will be described later.

Only the difference between the filling processing in FIG. 21B and that shown in the first embodiment will be described. When the ink consumption amount D is equal to or higher than the threshold value B in Step L02, the processing proceeds to Step L03 to set the driving speed to 10000 slits per second. When the ink consumption amount D is lower than the threshold value B on the other hand, the processing proceeds to Step L04 to set the driving speed to 2000 slits per second. The driving number is 15 regardless of the ink consumption amount and the driving speed is 2000 slits per second. Specifically, according to the ink filling operation in this embodiment, the driving speed when the main tank used up is higher than the driving speed just after the exchange of the main tank. This can consequently reduce the waiting time during which a user has to wait when the ink in the main tank is used up.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170340 filed Aug. 25, 2014, which is hereby incorporated by reference wherein in its entirety.

What is claimed is:

1. A printing apparatus comprising:

a main tank for containing ink;

a sub tank for containing ink supplied from the main tank and containing ink to be supplied to a print head;

a detection unit configured to detect an ink amount in the sub tank; and a filling unit configured to perform ink filling operation that fills the sub tank with ink from the main tank by driving a driving unit, in a case where the detection unit detects the ink amount in the sub tank that is less than a first predetermined amount, wherein in a case where the ink amount in the main tank is less than a second predetermined amount, the filling unit drives the driving unit at smaller drive amount than that in a case where the ink amount in the main tank is greater than the second predetermined amount.

2. The printing apparatus according to claim 1, further comprising determining unit configured to determine that the ink amount in the main tank is less than a predetermined remaining amount after the ink filling operation is performed, in a case where the ink amount detected by the detection unit is less than the first predetermined amount and the ink amount in the main tank is equal to or less than the second predetermined amount.

3. The printing apparatus according to claim 1, wherein the drive amount is number of times of the ink filling operation.

4. The printing apparatus according to claim 1, wherein the drive amount corresponds to a drive speed of the driving unit when performing the ink filling operation.

5. The printing apparatus according to claim 1, wherein the ink amount in the main tank is acquired based on ink consumption amount in the printing apparatus after exchange of the main tank.

6. The printing apparatus according to claim 5, wherein determination is performed for the main tank that an ink amount is the second predetermined amount if the ink consumption amount is greater than a predetermined threshold value.

7. The printing apparatus according to claim 1, wherein in a case where the ink amount detected by the detection unit is less than the first predetermined amount and the ink amount in the main tank equal to or less than the second predetermined amount before a printing operation is executed, the ink filling unit performs the ink filling operation after the printing operation is executed.

8. The printing apparatus according to claim 1, wherein in a case where the ink amount detected by the detection unit is less than the first predetermined amount and the ink amount in the main tank equal to or less than the second predetermined amount before a printing operation is executed, the ink filling unit performs the ink filling operation after waiting the printing operation predetermined waiting time that is shorter than waiting time in a case of not performing the ink filling operation.

9. The printing apparatus according to claim 1, wherein in a case where the ink amount detected by the detection unit is less than the first predetermined amount and the ink amount in the main tank equal to or less than the second predetermined amount after a printing operation is executed, the ink filling unit performs the first ink filling operation.

10. An ink filling method for filling a sub tank with ink in a printing apparatus including a main tank for containing ink, the sub tank for containing ink supplied from the main tank and containing ink to be supplied to a print head, and a detection unit configured to detect an ink amount in the sub tank, the method comprising:

a step of filling the sub tank with ink from the main tank by driving a driving unit, in a case where the detection unit detects the ink amount in the sub tank that is less than a first predetermined amount, wherein in the step, in a case where the ink amount in the main tank is equal to or less than a second predetermined amount, the driving unit is driven at smaller drive amount than that in a case where the ink amount in the main tank is greater than the second predetermined amount.

* * * * *